US011293112B2

(12) United States Patent
Iou

(10) Patent No.: US 11,293,112 B2
(45) Date of Patent: Apr. 5, 2022

(54) ELECTRODE FRAME

(71) Applicant: U-PRO MACHINES CO., LTD., Taoyuan (TW)

(72) Inventor: Hsin-Chi Iou, Taoyuan (TW)

(73) Assignee: U-Pro Machines Co., Ltd., Taoyuan (TW)

( * ) Notice: Subject to any disclaimer, the term of this patent is extended or adjusted under 35 U.S.C. 154(b) by 0 days.

(21) Appl. No.: 17/074,910

(22) Filed: Oct. 20, 2020

(65) Prior Publication Data

US 2021/0123154 A1 Apr. 29, 2021

(30) Foreign Application Priority Data

Oct. 23, 2019 (TW) ..... 108138278

(51) Int. Cl.
*C25D 17/08* (2006.01)
*C25D 17/12* (2006.01)
*C25D 17/00* (2006.01)

(52) U.S. Cl.
CPC ..... *C25D 17/08* (2013.01); *C25D 17/005* (2013.01); *C25D 17/12* (2013.01)

(58) Field of Classification Search
None
See application file for complete search history.

(56) References Cited

U.S. PATENT DOCUMENTS 9,865,493 B2 * 1/2018 Yoshioka ..... C25D 17/001
2006/0191786 A1 * 8/2006 Yamamoto ..... C25D 17/06 204/297.06
2015/0225868 A1 * 8/2015 Rauenbusch ..... C25D 17/001 204/297.02
2020/0199770 A1 * 6/2020 Moriyama ..... C25D 17/001

* cited by examiner

*Primary Examiner* — Louis J Rufo
(74) *Attorney, Agent, or Firm* — Rosenberg, Klein & Lee

(57) ABSTRACT

A electrode frame having the first frame group covered the first conductive frame strip, and the first conductive frame strip has first frame strip conductive component and multiple first substrate conductive components; the second frame group covered the second conductive frame strip, and the second conductive frame strip has second frame strip conductive component and multiple second substrate conductive components; when the first frame group and the second frame group are combined, above mentioned components are all electrically connected; the conductive hanger conducts electricity to the inner frame strips, then conducts electricity to the first and second substrate conductive components, and the substrate conductive components separately electrically connect to lateral side of the substrate for making the electric current conduct uniformly on the both lateral side and the surrounding of the substrate.

9 Claims, 10 Drawing Sheets

ELECTRODE FRAME

BACKGROUND OF THE INVENTION

1. Field of the Invention

The invention relates to an electrode frame, especially to one that can let the electric current uniformly distribute on both side of the electrode substrate and the four peripheries of the electrode frame.

2. Description of the Related Art

The function of the electrode frame is for electric conduction and securing the substrate, and the conventional electrode frames mostly are design with multiple top clamps and bottom clamps holding the non-effect area of the substrate; However, during the electroplating, the electric current come from the hanger which arranged on the top, letting the current conduct from the top clamps to the substrate, since the electric current is concentrated at the top clamping point of the substrate, the plating of the substrate will be uneven; Also, because the top clamp only contacts the frame with the positioning side not the free side, causing the electric current only concentrate on one side of the substrate and further causing the plating of the substrate being uneven.

SUMMARY OF THE INVENTION

It is a primary objective of the present invention to solve the uneven plating problem of the prior art.

In order to achieve the above objectives, the present invention includes: at least a conductive hanger; a first frame group having a first outer frame, a first conductive frame strip, and a first inner frame, the first outer frame and the first inner frame are combined and further cover and clamp the first conductive frame strip, the first inner frame correspondingly to the first conductive frame strip has at least a first frame strip conductive component and multiple first substrate conductive components, the first frame strip conductive component and the first substrate conductive components protrude out of the first inner frame, the first substrate conductive components is electrically connected to the first conductive frame strip, the first frame strip conductive component, the first conductive frame strip, and the conductive hanger are electrically connected; and a second frame group having a second outer frame, a second conductive frame strip, and a second inner frame, the second outer frame and the second inner frame are combined and further cover and clamp the second conductive frame strip, the second inner frame correspondingly to the second conductive frame strip has at least a second frame strip conductive component and multiple second substrate conductive components, the second frame strip conductive component and the second substrate conductive components protrude out of the second inner frame, the second substrate conductive components is electrically connected to the second conductive frame strip; whereby when the first frame group and the second frame group combined will make the second frame strip conductive component, the second conductive frame strip, and the first frame strip conductive component electrically connected, each of the first substrate conductive components will be electrically connected to the first lateral side of the electroplating substrate, and each of the second substrate conductive components will be electrically connected to the second lateral side of the electroplating substrate.

Also, the first frame strip conductive component has a conductive block and a first waterproof sealing ring, the second frame strip conductive component has a frame strip conductive plate and a second water proof sealing ring, when the first frame group and the second frame group combined together, the conductive block and the frame strip conductive plate are electrically connected, and the first water proof sealing ring and the second water proof sealing ring are combined and further covered the conductive block and the frame strip conductive plate to achieve waterproof; wherein the conductive block, the first conductive frame strip, and the conductive hanger are electrically connected by a conductive combination unit, the frame strip conductive plate has a positioning part and an elastic sheet part, the positioning part is attached on the second conductive frame strip and secured by a positioning block and a combination unit, and the elastic sheet part has an elastic unit arranged at the inner side.

Also, both of the first substrate conductive component and the second substrate conductive component have a substrate conductive plate and a waterproof ring, when the first frame group and the second frame group are combined, each substrate conductive plate is electrically connected to the electroplating substrate, and each waterproof ring is attached on the electroplating substrate and covered the substrate conductive plate to achieve waterproof; wherein the substrate conductive plate has a positioning part and an elastic sheet part, the positioning part is attached to the first conductive frame strip and the second conductive frame strip and secured by a positioning block and a combination unit, and elastic sheet part has an elastic unit arranged at the inner side.

Also, the first outer frame or the first inner frame has a first frame strip containing slot corresponded to the first conductive frame strip, and the second outer frame or the second inner frame has a second frame strip containing slot corresponded to the second conductive frame strip; wherein the first frame strip containing slot is close to the inner periphery of the first outer frame or the first inner frame, and the second frame strip containing slot is close to the inner periphery of the second outer frame or the second inner frame. The exposed surface of the first inner frame has multiple conductive pins, and the second inner frame has multiple conductive holes corresponds to the conductive pins; And the first frame group and the second frame group are combined by multiple elastic locks.

Also, the first frame group is covered the first conductive frame strip, and the first conductive frame strip has first frame strip conductive component and multiple first substrate conductive components; the second frame group is covered the second conductive frame strip, and the second conductive frame strip has second frame strip conductive component and multiple second substrate conductive components; when the first frame group and the second frame group are combined, the second frame strip conductive component, the second conductive frame strip, the first frame strip conductive component, the first conductive frame strip and the conductive hanger are electrically connected; the conductive hanger conducts electricity to the first and second conductive frame strip, then the first and second conductive frame strip circuit conducts electricity to the first and second substrate conductive components, and the first and second substrate conductive components separately electrically connect to the first lateral side and the second lateral side of the substrate for making the electric current conduct uniformly on the both lateral side and the surrounding of the substrate.

DETAILED DESCRIPTION OF THE PREFERRED EMBODIMENT

Figure 1:
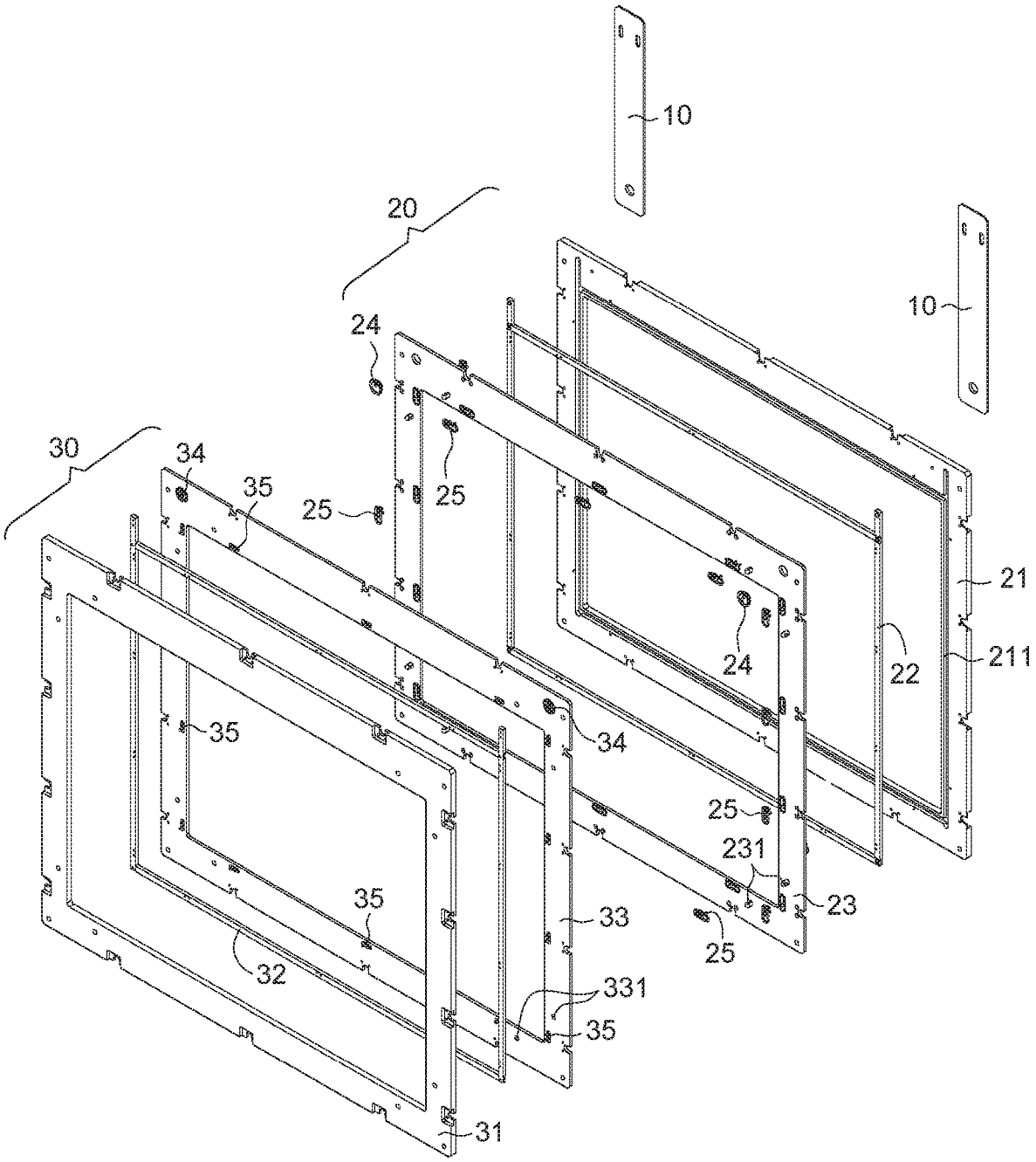
FIG. 1 is an exploded perspective views of the present invention.
Figure 2:
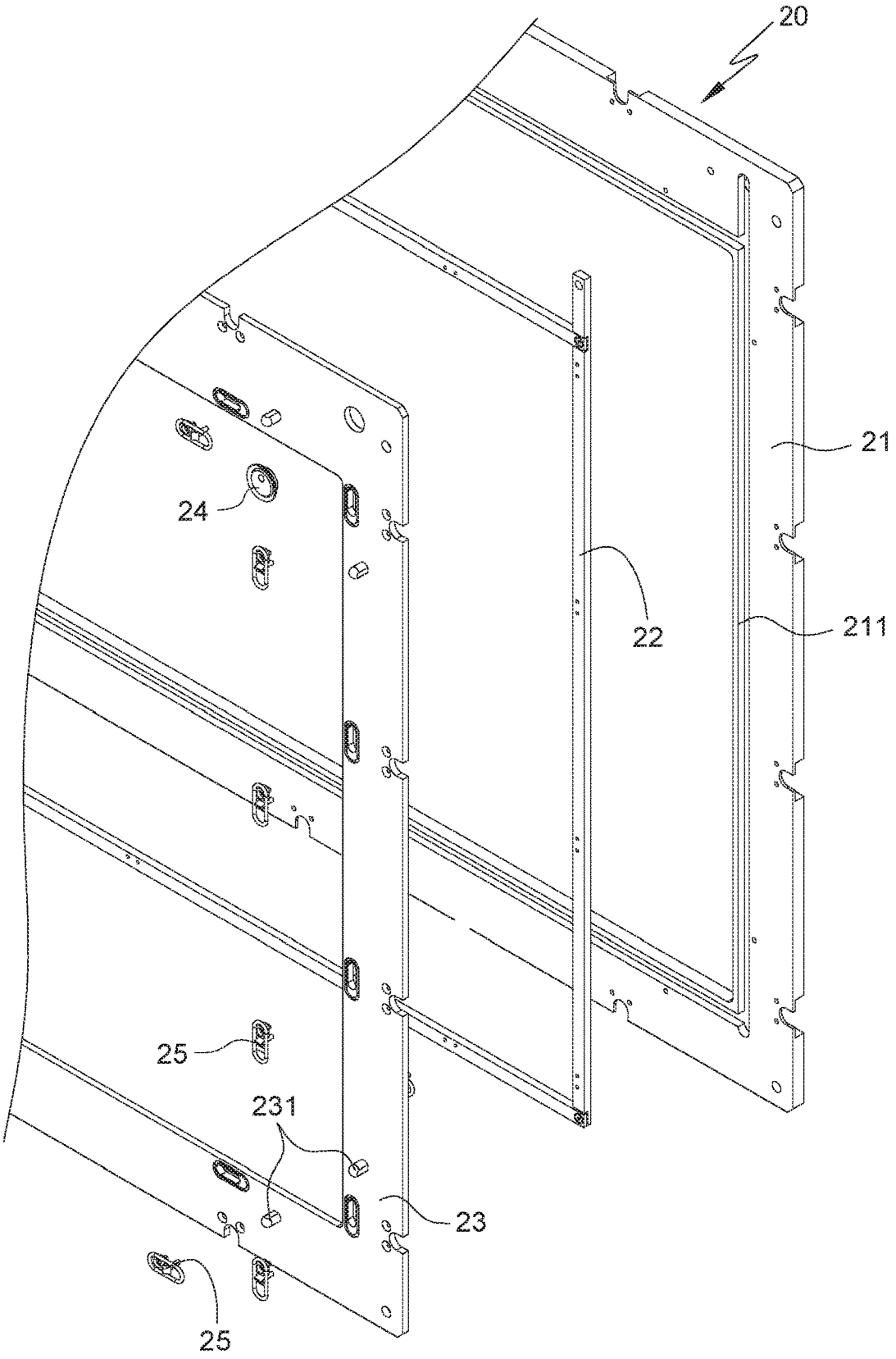
FIG. 2 is a zoom-in of the exploded perspective views of the present invention.
Figure 3:
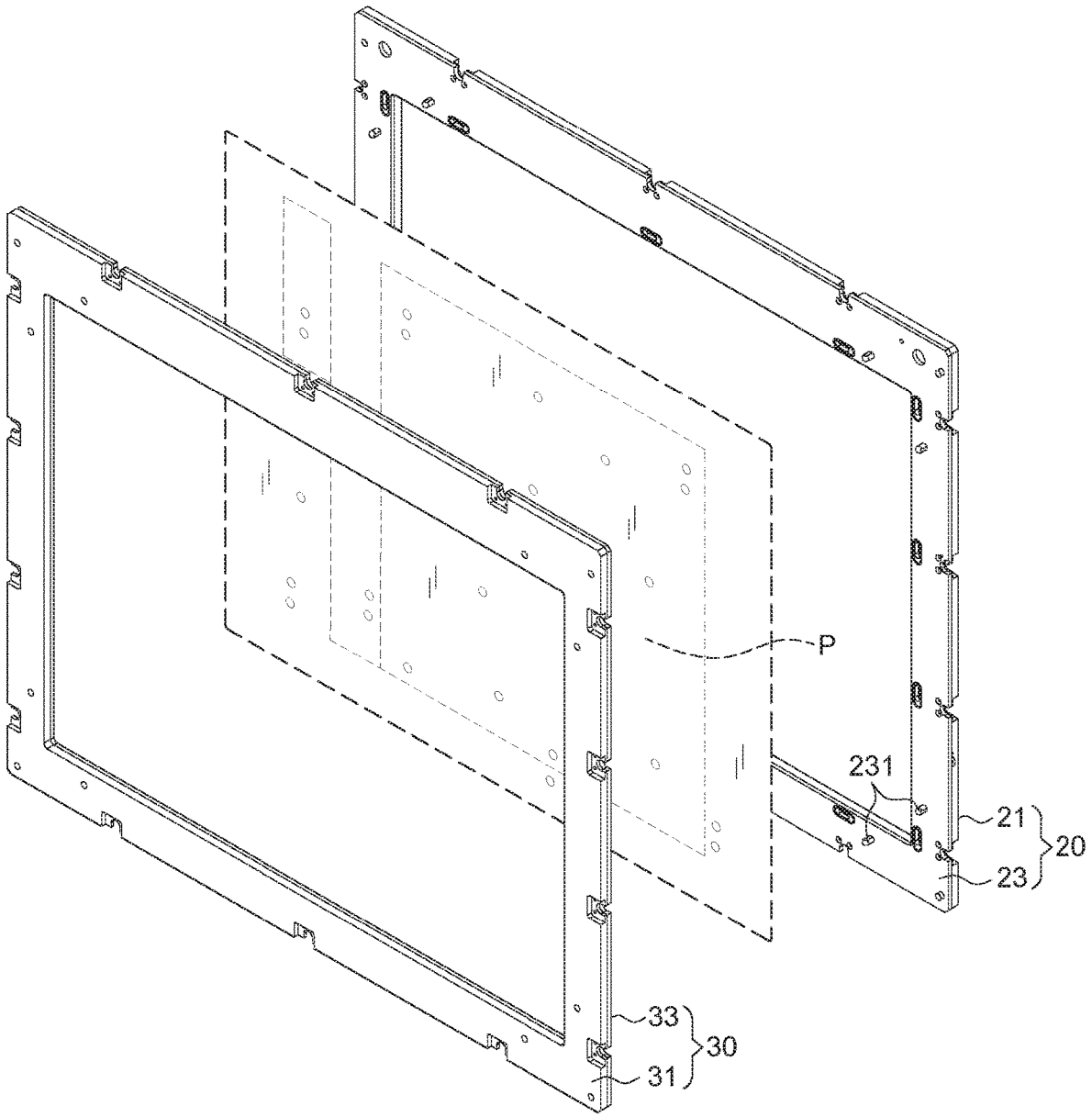
FIG. 3 is an exploded perspective views of the partial present invention.
Figure 4:
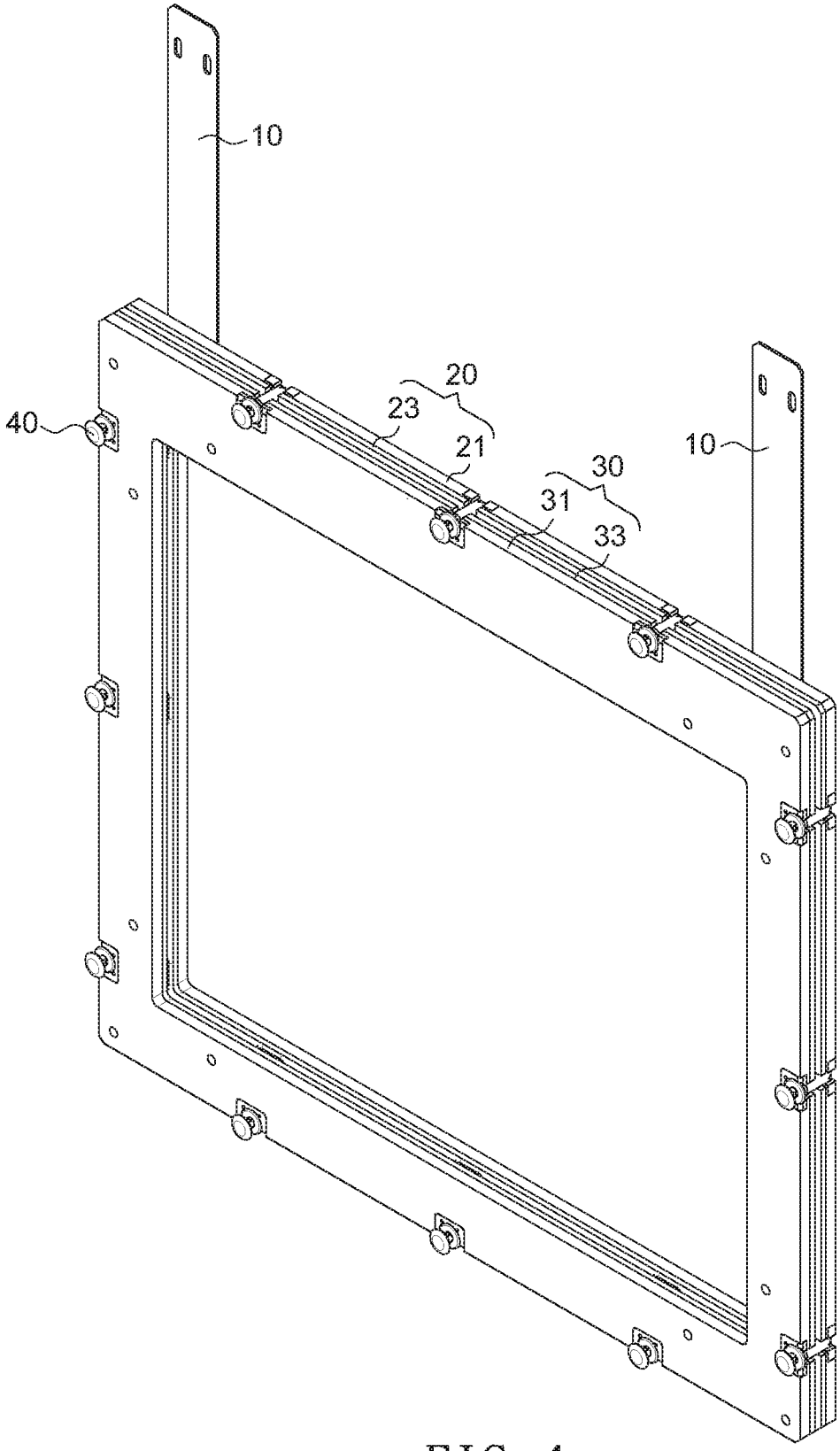
FIG. 4 is a schematic diagram illustrating the structure of the present invention.

Referring to FIGS. 1-5, An electrode frame, comprising: at least a conductive hanger 10; a first frame group 20 having a first outer frame 21, a first conductive frame strip 22, and a first inner frame 23, the inner periphery of the first outer frame 21 or the first inner frame 23 has a first frame strip containing slot 211 corresponds to the first conductive frame strip 22, the first outer frame 21 and the first inner frame 23 are combined and further cover and clamp the first conductive frame strip 22, the first inner frame 23 correspondingly to the first conductive frame strip 22 has at least a first frame strip conductive component 24 and multiple first substrate conductive components 25, the first frame strip conductive component 24 and the first substrate conductive components 25 protrude out of the first inner frame 23, the first substrate conductive components 25 is electrically connected to the first conductive frame strip 22, the first frame strip conductive component 24, the first conductive frame strip 22, and the conductive hanger 20 are electrically connected; and a second frame group 30 having a second outer frame 31, a second conductive frame strip 32, and a second inner frame 33, the inner periphery of the second outer frame 31 or the second inner frame 33 has a second frame strip containing slot 311 corresponds to the second conductive frame strip 32, the second outer frame 31 and the second inner frame 33 are combined and further cover and clamp the second conductive frame strip 32, the second inner frame 33 correspondingly to the second conductive frame strip 32 has at least a second frame strip conductive component 34 and multiple second substrate conductive components 35, the second frame strip conductive component 34 and the second substrate conductive components 35 protrude out of the second inner frame 33, the second substrate conductive components 35 is electrically connected to the second conductive frame strip 32; whereby the exposed surface of the first inner frame 23 has multiple conductive pins 231 and the second inner frame 33 has multiple conductive holes 331 corresponds to the conductive pins 231, when the first frame group 20 and the second frame group 30 are combined by multiple elastic locks 40 will make the second frame strip conductive component 34, the second conductive frame strip 32, and the first frame strip conductive component 24 electrically connected, each of the first substrate conductive components 25 will be electrically connected to the first lateral side of the electroplating substrate P, and each of the second substrate conductive components 35 will be electrically connected to the second lateral side of the electroplating substrate P.

Figure 5:
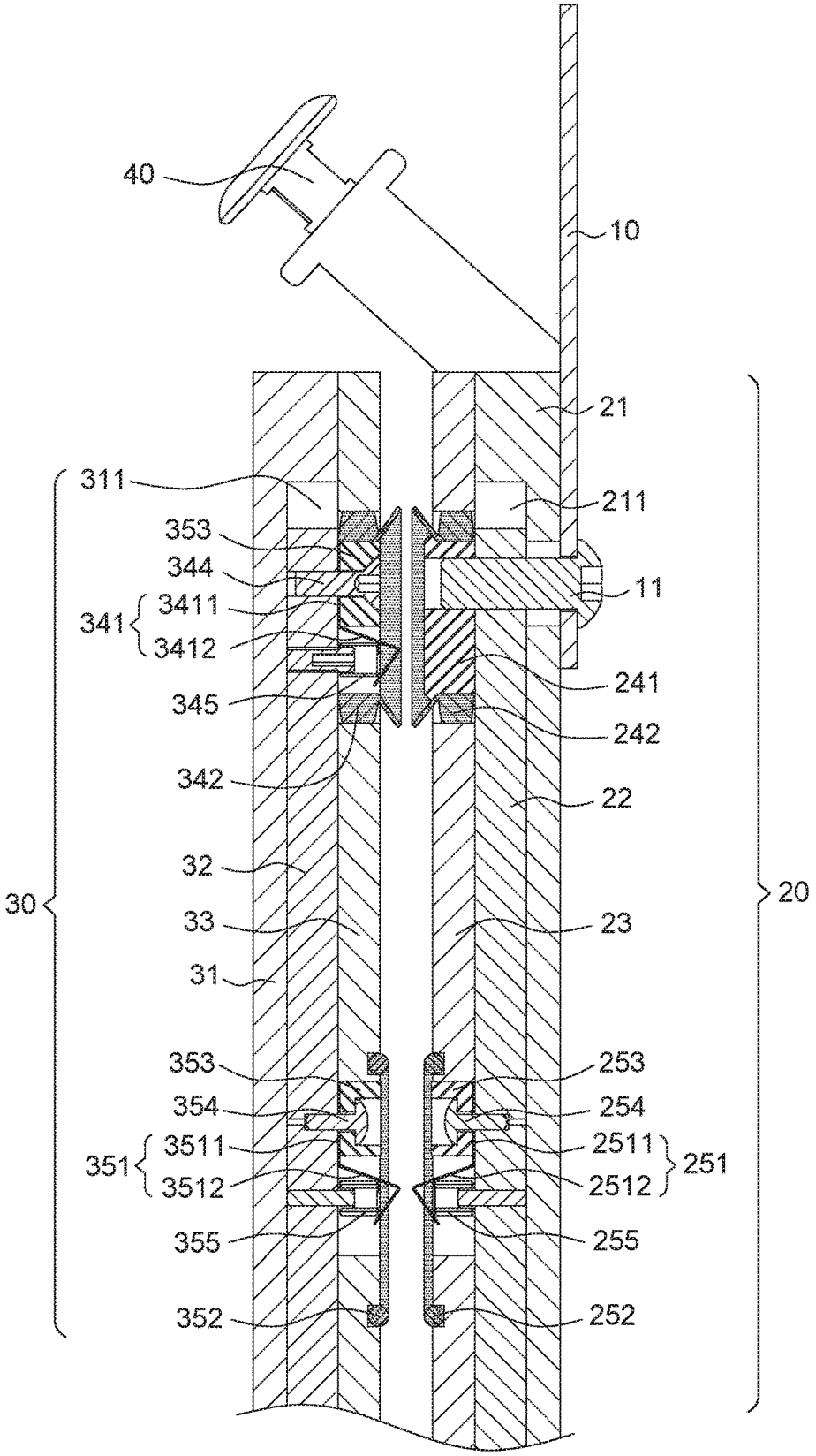
FIG. 5 is a sectional view of the partial present invention.
Figure 6:
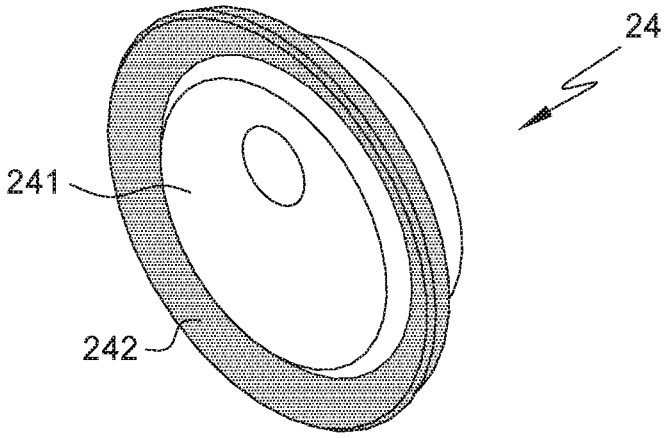
FIG. 6 is a schematic diagram illustrating the structure of the first frame strip conductive component.
Figure 7:
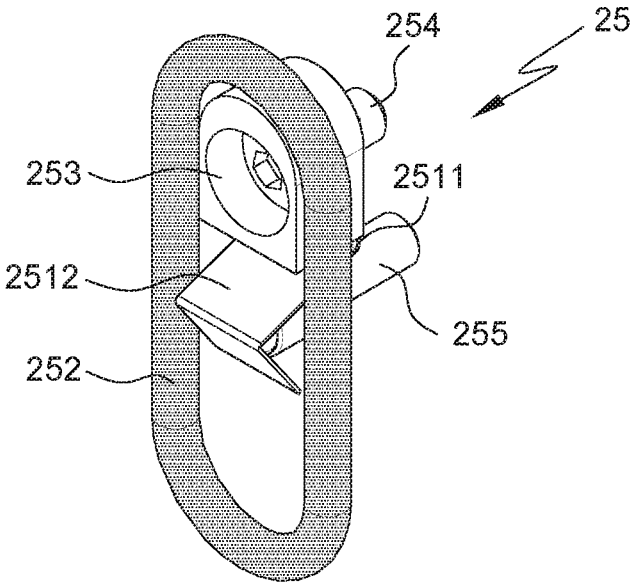
FIG. 7 is a schematic diagram illustrating the structure of the first substrate conductive component.
Figure 8:
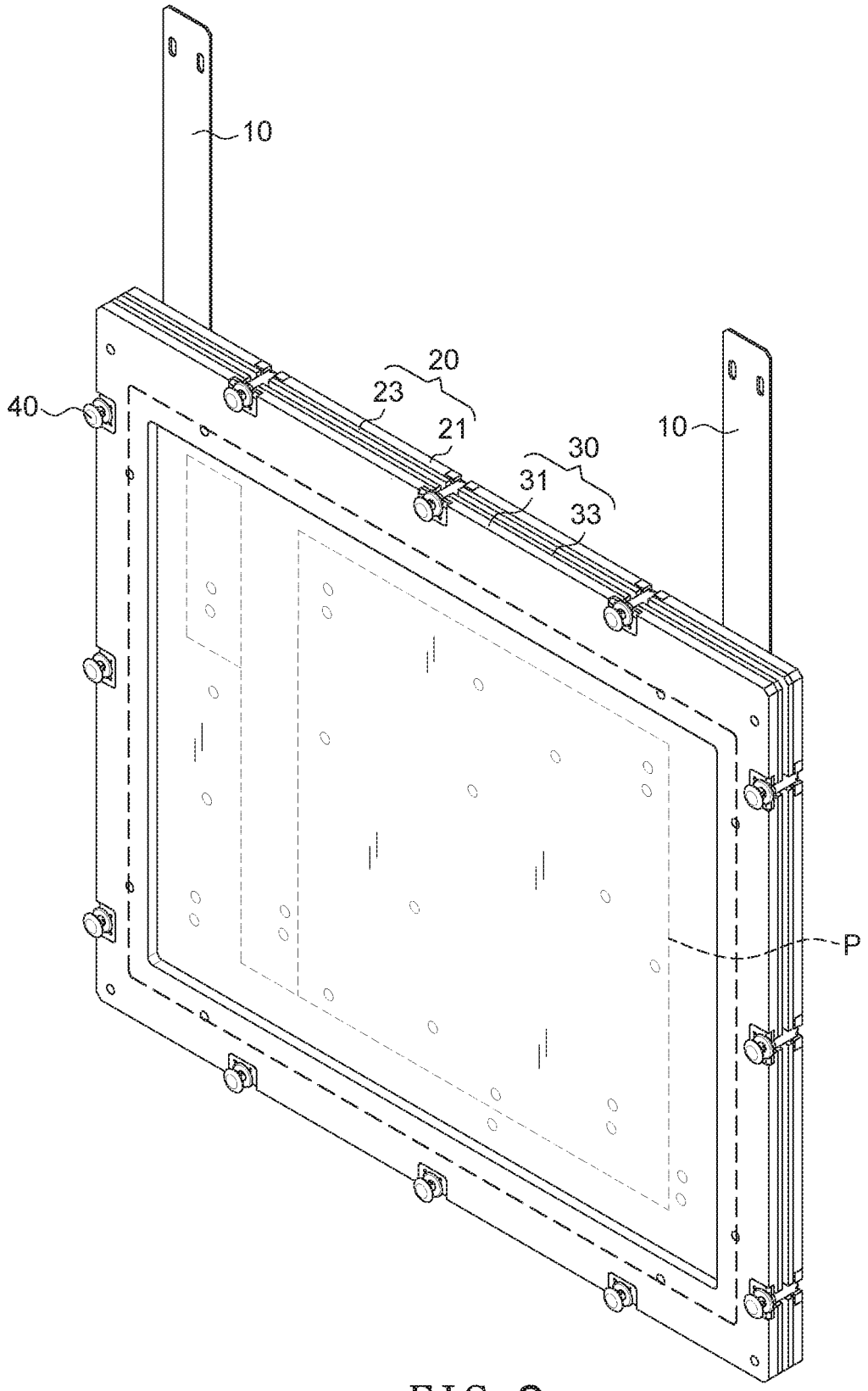
FIG. 8 is a schematic diagram illustrating the present invention clamping a substrate.

Also, referring to FIGS. 5-6, the first frame strip conductive component 24 has a conductive block 241 and a first waterproof sealing ring 242, the conductive block 241, the first conductive frame strip 22, and the conductive hanger 10 are electrically connected by a conductive combination unit 11; FIG. 5 and FIG. 6, the first substrate conductive component 25 has a substrate conductive plate 251 and a waterproof ring 252, when the first frame group 20 and the second frame group 30 are combined, each substrate conductive plate 251 is electrically connected to the electroplating substrate, and each waterproof ring 252 is attached on the electroplating substrate and covered the substrate conductive plate 251 to achieve waterproof; wherein the substrate conductive plate 251 has a positioning part 2511 and an elastic sheet part 2512, the positioning part 2512 is attached to the first conductive frame strip 22 and secured by a positioning block 253 and a combination unit 254, and elastic sheet part 2512 has an elastic unit 255 arranged at the inner side; the first substrate conductive component 25 and the second substrate conductive component 35 have the same structure, the second substrate conductive component 35 has a substrate conductive plate 351 and a waterproof ring 352, when the first frame group 20 and the second frame group 30 are combined, each substrate conductive plate 351 is electrically connected to the electroplating substrate, and each waterproof ring 352 is attached on the electroplating substrate and covered the substrate conductive plate 351 to achieve waterproof; wherein the substrate conductive plate 351 has a positioning part 3511 and an elastic sheet part 3512, the positioning part 3511 is attached to the second conductive frame strip 32 and secured by a positioning block 353 and a combination unit 354, and the elastic sheet part 352 has an elastic unit 355 arranged at the inner side.

Moreover, the second frame strip conductive component 34 and the second substrate conductive component 35 has similar structure, the second frame strip conductive component 34 has a frame strip conductive plate 341 and a second waterproof sealing ring 342; when the first frame group 20 and second frame group 30 are combined, the conductive block 241 and the frame strip conductive plate 341 is electrically connected, and the first waterproof sealing ring 242 and the second waterproof sealing ring 342 are attached to each other and cover the conductive block 241 and the frame strip conductive plate 341 to achieve waterproof; the frame strip conductive plate 341 has a positioning part 3411 and an elastic sheet part 3412, the positioning part 3411 is attached on the second conductive frame strip 32 and secured by a positioning block 343 and a combination unit 344, and the elastic sheet part 3412 has an elastic unit 345 arranged at the inner side.

Figure 9:
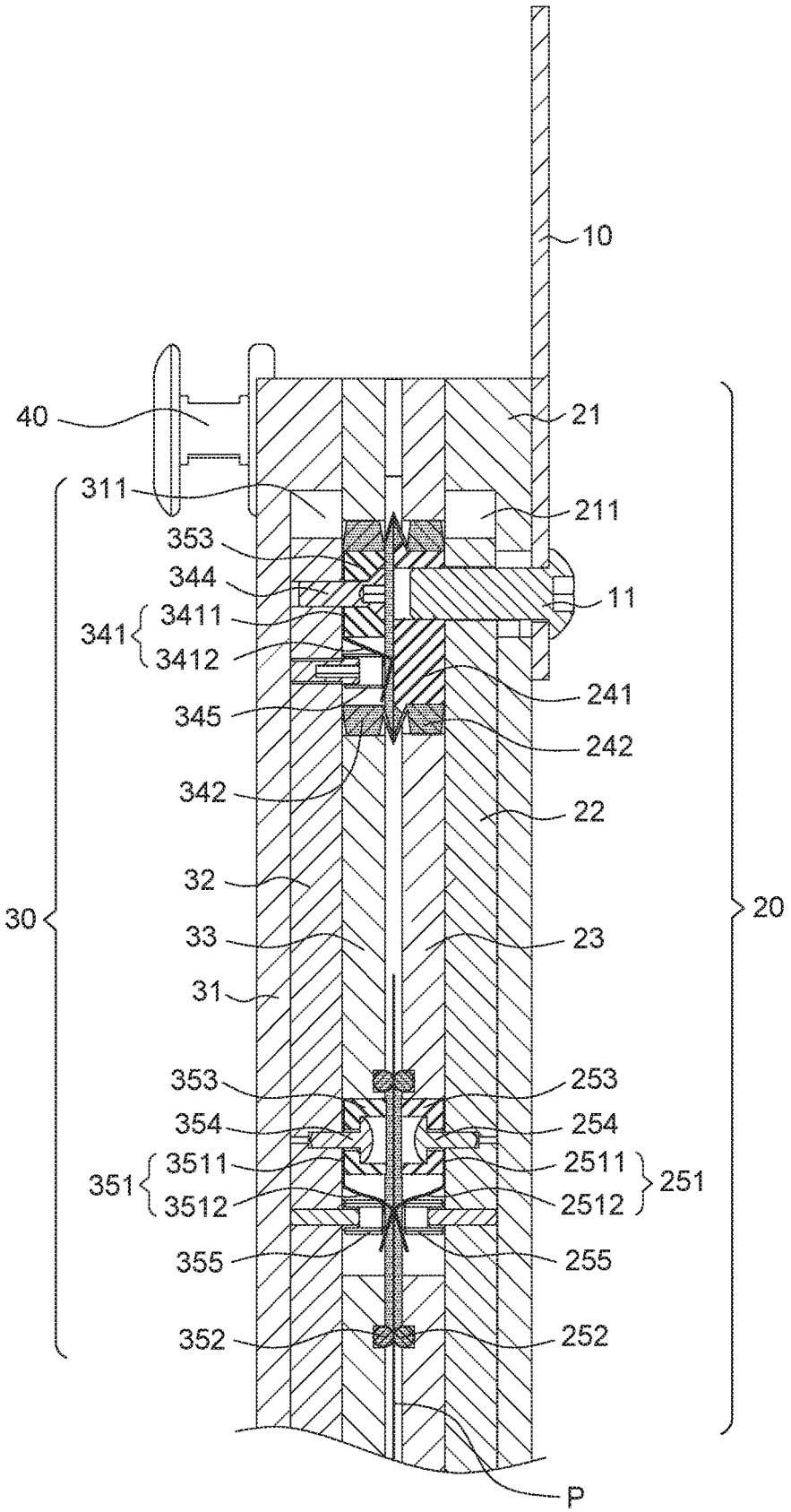
FIG. 9 is a partial sectional view of the present invention clamping a substrate.
Figure 10:
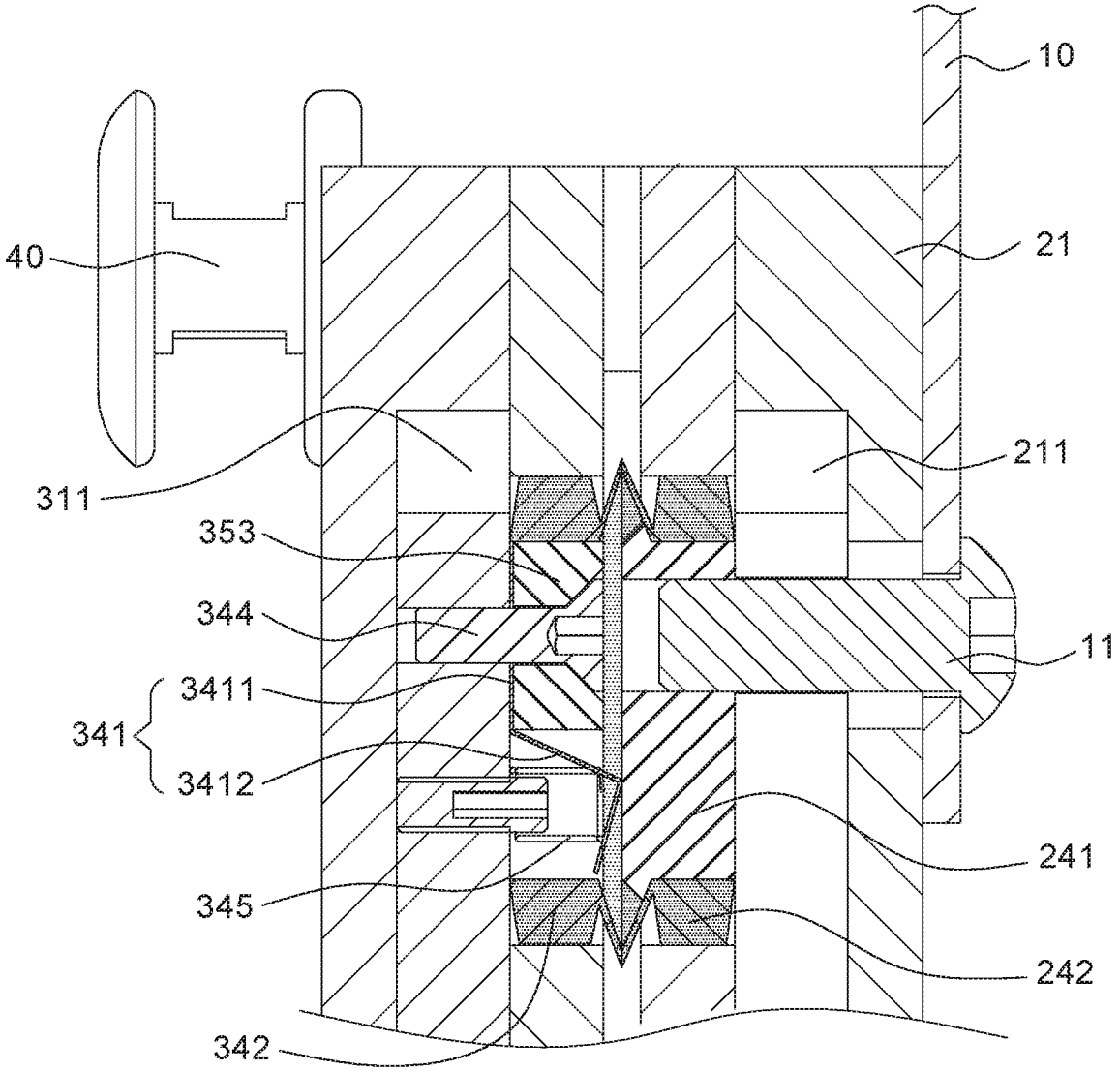
FIG. 10 a zoom-in of the partial structure of the FIG. 9.
Figure 11:
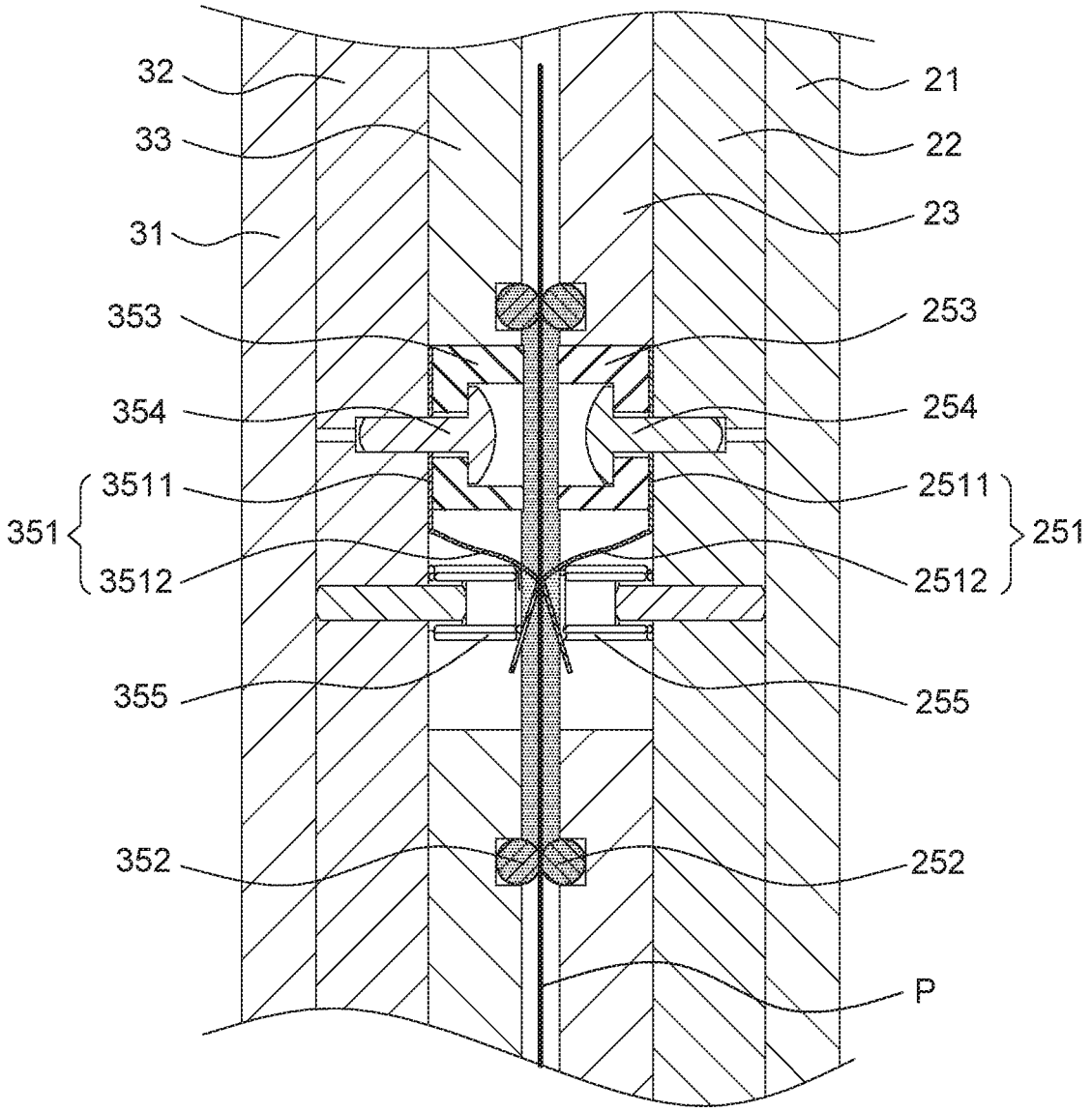
FIG. 11 another zoom-in of the partial structure of the FIG. 9.

Referring to the FIGS. 8-11, with the feature disclosed above, the first frame group 20 covers and clamps the first conductive frame strip 22, correspondingly to the first conductive frame strip 22 has at least a first frame strip conductive component 24 and multiple first substrate conductive components 25; the second frame group 30 covers and clamps the second conductive frame strip 32, correspondingly to the second conductive frame strip 32 has at least a second frame strip conductive component 34 and multiple second substrate conductive components 35; when the first frame group 20 and the second frame group 30 are combined, the second frame strip conductive component 34, the second conductive frame strip 32, the first frame strip conductive component 24, the first conductive frame strip 22 and the conductive hanger 10 are electrically connected, as FIG. 9 and FIG. 10 showing; the conductive hanger 10 conducts electricity to the first conductive frame strip 22 and second conductive frame strip 32, then first conductive frame strip 22 and second conductive frame strip 32 circuit conducts electricity to the first substrate conductive components 25 and second substrate conductive components 35, and the first substrate conductive components 25 and second substrate conductive components 35 separately electrically connect to the first lateral side and the second lateral side of the substrate P, as FIG. 9 and FIG. 11 showing, for making the electric current conduct uniformly on the both lateral side and the surrounding of the substrate and further enhance the uniformly plating effect of the substrate.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An electrode frame, comprising:

at least a conductive hanger;

a first frame group having a first outer frame, a first conductive frame strip, and a first inner frame, the first outer frame and the first inner frame are combined and further cover and clamp the first conductive frame strip, the first inner frame correspondingly to the first conductive frame strip has at least a first frame strip conductive component and multiple first substrate conductive components, the first frame strip conductive component and the first substrate conductive components protrude out of the first inner frame, the first substrate conductive components is electrically connected to the first conductive frame strip, the first frame strip conductive component, the first conductive frame strip, and the conductive hanger are electrically connected; and a second frame group having a second outer frame, a second conductive frame strip, and a second inner frame, the second outer frame and the second inner frame are combined and further cover and clamp the second conductive frame strip, the second inner frame correspondingly to the second conductive frame strip has at least a second frame strip conductive component and multiple second substrate conductive components, the second frame strip conductive component and the second substrate conductive components protrude out of the second inner frame, the second substrate conductive components is electrically connected to the second conductive frame strip;

whereby when the first frame group and the second frame group combined will the make second frame strip conductive component, the second conductive frame strip and the first frame strip conductive component electrically connected, each of the first substrate conductive components will be electrically connected to the first lateral side of the electroplating substrate, and each of the second substrate conductive components will be electrically connected to the second lateral side of the electroplating substrate.

2. The electrode frame as claimed in claim 1, wherein the first frame strip conductive component has a conductive block and a first waterproof sealing ring, the second frame strip conductive component has a frame strip conductive plate and a second water proof sealing ring, when the first frame group and the second frame group combined together, the conductive block and the frame strip conductive plate are electrically connected, and the first water proof sealing ring and the second water proof sealing ring are combined and further covered the conductive block and the frame strip conductive plate to achieve waterproof.

3. The electrode frame as claimed in claim 2, wherein the conductive block, the first conductive frame strip and the conductive hanger are electrically connected by a conductive combination unit, the frame strip conductive plate has a positioning part and an elastic sheet part, the positioning part is attached on the second conductive frame strip and secured by a positioning block and a combination unit, and the elastic sheet part has an elastic unit arranged at the inner side.

4. The electrode frame as claimed in claim 1, wherein both of the first substrate conductive component and the second substrate conductive component have a substrate conductive plate and a waterproof ring, when the first frame group and the second frame group are combined, each substrate conductive plate is electrically connected to the electroplating substrate, and each waterproof ring is attached on the electroplating substrate and covered the substrate conductive plate to achieve waterproof.

5. The electrode frame as claimed in claim 4, wherein the substrate conductive plate has a positioning part and an elastic sheet part, the positioning part is attached to the first conductive frame strip and the second conductive frame strip and secured by a positioning block and a combination unit, and the elastic sheet part has an elastic unit arranged at the inner side.

6. The electrode frame as claimed in claim 1, wherein the first outer frame or the first inner frame has a first frame strip containing slot corresponded to the first conductive frame strip, and the second outer frame or the second inner frame has a second frame strip containing slot corresponded to the second conductive frame strip.

7. The electrode frame as claimed in claim 6, wherein the first frame strip containing slot is close to the inner periphery of the first outer frame or the first inner frame, and the second frame strip containing slot is close to the inner periphery of the second outer frame or the second inner frame.

8. The electrode frame as claimed in claim 1, wherein the exposed surface of the first inner frame has multiple conductive pins, and the second inner frame has multiple conductive holes corresponds to the conductive pins.

9. The electrode frame as claimed in claim 1, wherein the first frame group and the second frame group are combined by multiple elastic locks.

* * * * *